US008044531B2

(12) United States Patent
Kobayashi et al.

(10) Patent No.: US 8,044,531 B2
(45) Date of Patent: Oct. 25, 2011

(54) ENGINE STARTING DEVICE

(75) Inventors: Masaki Kobayashi, Saitama (JP); Kenichi Machida, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 262 days.

(21) Appl. No.: 12/461,461

(22) Filed: Aug. 12, 2009

(65) Prior Publication Data

US 2010/0078994 A1 Apr. 1, 2010

(30) Foreign Application Priority Data

Sep. 26, 2008 (JP) ..... 2008-247708

(51) Int. Cl.
*F02P 9/00* (2006.01)

(52) U.S. Cl. ..... 307/10.6

(58) Field of Classification Search ..... 307/10.3, 307/10.6; 123/179.3, 179.1, 198 DC; 290/38 R
See application file for complete search history.

(56) References Cited

U.S. PATENT DOCUMENTS 6,138,059 A * 10/2000 Ozeki et al. ..... 701/1
6,276,472 B1 * 8/2001 Takashima et al. ..... 180/65.21
6,415,210 B2 * 7/2002 Hozuka et al. ..... 701/29
6,717,291 B2 * 4/2004 Purkey ..... 307/10.6
7,628,138 B2 * 12/2009 Ando ..... 123/406.13

FOREIGN PATENT DOCUMENTS

JP 03-279675 10/1991

* cited by examiner

*Primary Examiner* — Albert W Paladini
(74) *Attorney, Agent, or Firm* — Squire, Sanders & Dempsey (US) LLP

(57) ABSTRACT

An engine starting device includes an ignition switch configured to cause turning-on and off of a main power source line connecting a power source for a vehicle and an engine control unit (ECU). The ignition switch includes a stationary contact and a movable contact that is rotatable relative to the stationary contact. The stationary contact includes a main contact configured to be connected to a power source input section of the ECU and a starter contact configured to be connected to a starter. The engine starting device also includes a relay provided on a sub power source line that is connected in parallel to the main power source line, the relay connecting the power source of the vehicle and a sub power source input section of the ECU, the relay being excited by the start of the ECU and providing electric continuity between the power source and the ECU.

21 Claims, 5 Drawing Sheets

ENGINE STARTING DEVICE

BACKGROUND

1. Field

The present invention relates to an engine starting device.

2. Description of Related Art

Conventionally, a starting device starts an engine by ignition or drives a starter by rotation of an ignition key. Generally, the starting device includes a key contact that can be rotated about a key contact shaft support, an off-terminal configured to be contacted by the key contact, an ignition terminal (that turns the main power source on), and a starter terminal. When the ignition key is rotated to a position of the ignition terminal, the main power source is turned on. When the ignition key is rotated to a position of the starter terminal, a voltage is applied to both the ignition terminal and the starter terminal from a battery and a starter motor is driven to start an engine.

However, in such a starting device, a terminal of an ignition switch may deteriorate. In such a case, when the key contact located at the position of the ignition terminal is moved to the starter contact, chattering is produced and an instantaneous disconnection may occur in a power source line.

In an attempt to address this problem, a starting device has been proposed (see JP-A No. H3-279675) having a diode that allows electric current to flow from the side of the starter terminal to the side of the ignition terminal. The diode is provided between the ignition terminal and the starter terminal. When the starter terminal is in a connected state, the ignition terminal is configured to always be in an on-state, thus preventing deterioration in the ability of the starting device to start the engine due to the chattering.

However, in the engine starting device discussed above, when both a starter line (to which the starter terminal is connected), and a power source line (to which the ignition terminal is connected) are instantaneously disconnected due to the chattering, electric power is not supplied to an electronic control unit (ECU).

It is therefore desirable to provide an engine starting device that can prevent chattering.

SUMMARY

In an embodiment of the present invention, an engine starting device includes an ignition switch configured to cause turning-on and off of a main power source line connecting a power source for a vehicle and an engine control unit (ECU). The ignition switch includes a stationary contact and a movable contact that is rotatable relative to the stationary contact. The stationary contact includes a main contact configured to be connected to a power source input section of the ECU and a starter contact configured to be connected to a starter. The movable contact is configured switch its connection/disconnection with the respective contacts of the stationary contact by the rotation of the movable contact to an off-position, an on-position and a starter position relative to the stationary contact. Both the main contact and the starter contact are configured to be connected to the power source of the vehicle when the movable contact is rotated to the starter contact. The engine starting device also includes a relay provided on a sub power source line that is connected in parallel to the main power source line, the relay connecting the power source of the vehicle and a sub power source input section of the ECU, the relay being excited by the start of the ECU and providing electric continuity between the power source and the ECU.

In another embodiment of the present invention, a method includes rotating a movable contact relative to the stationary contact. The stationary contact includes a main contact connected to a power source input section of an engine control unit (ECU) and a starter contact connected to a starter. The movable contact switches its connection/disconnection with the respective contacts of the stationary contact by the rotation of the movable contact to an off-position, an on-position and a starter position relative to the stationary contact. Both the main contact and the starter contact are connected to the power source of a vehicle when the movable contact is rotated to the starter contact. The method also includes exciting a relay by the start of the ECU. The relay is provided on a sub power source line that is connected in parallel to the main power source line, the relay connects the power source of the vehicle and a sub power source input section of the ECU and the relay provides electric continuity between the power source and the ECU.

In yet another embodiment, an ignition switch includes a stationary contact and a movable contact that is rotatable relative to the stationary contact. The stationary contact includes a main contact configured to be connected to a power source input section of an engine control unit (ECU) and a starter contact configured to be connected to a starter. The movable contact is configured switch its connection/disconnection with the respective contacts of the stationary contact by the rotation of the movable contact to an off-position, an on-position and a starter position relative to the stationary contact. Both the main contact and the starter contact are configured to be connected to the power source of a vehicle when the movable contact is rotated to the starter contact. Operation of a relay is stopped after a passage of a first predetermined time following the movable contact being rotated to the off-position, the relay being released from an electric continuity state.

BRIEF DESCRIPTION OF THE DRAWINGS

In order that the embodiments of the invention will be readily understood, a more particular description of the invention briefly described above will be rendered by reference to specific embodiments that are illustrated in the appended drawings. While it should be understood that these drawings illustrate only typical embodiments of the invention and are not therefore to be considered to be limiting of its scope, the invention will be described and explained with additional specificity and detail through the use of the accompanying drawings, in which:

FIG. 1(*b*) illustrates an internal view of an ignition switch exposing a stationary contact according to an embodiment of the present invention.

FIG. 1(*c*) illustrates an internal view of an ignition switch exposing a movable contact according to an embodiment of the present invention.

FIG. 2(*b*) illustrates an internal view of an ignition switch exposing a stationary contact and a movable contact in the on position according to an embodiment of the present invention.

FIG. 2(*c*) illustrates an internal view of an ignition switch exposing a stationary contact and a movable contact in the starter position according to an embodiment of the present invention.

DETAILED DESCRIPTION

Figure 1:
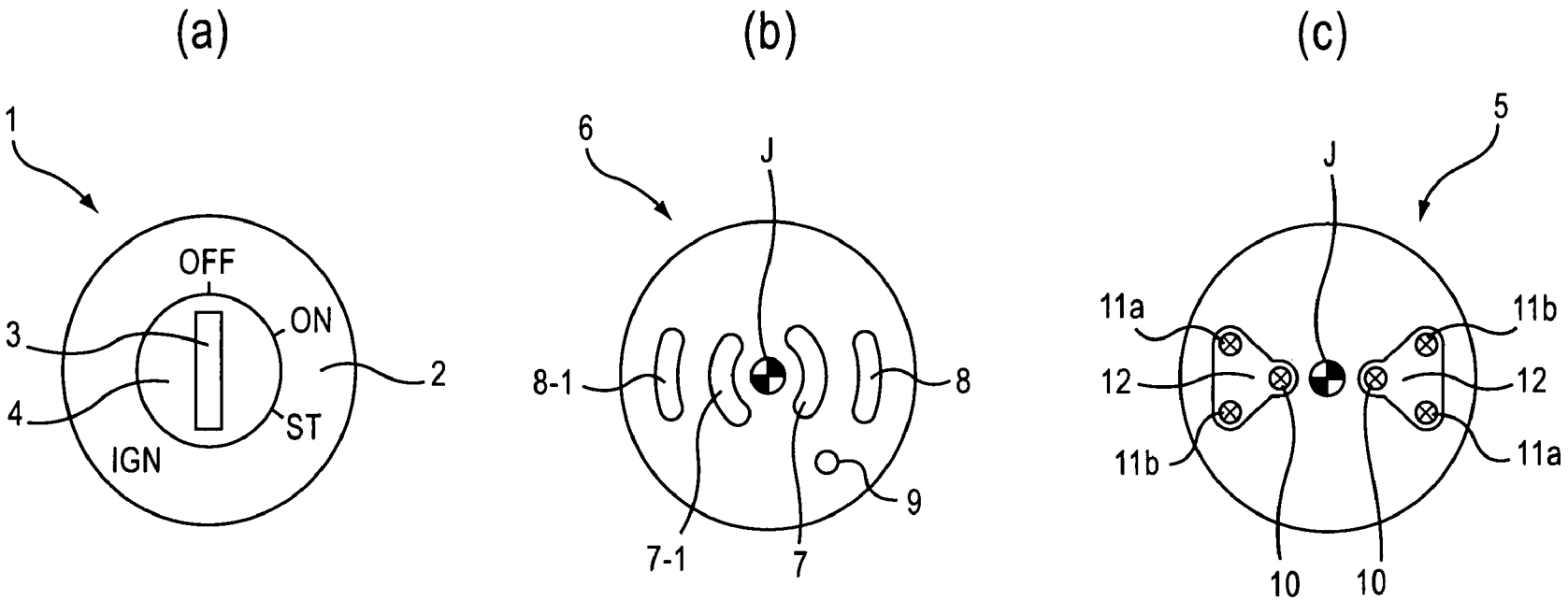
FIG. 1(*a*) illustrates an external view of an ignition switch according to an embodiment of the present invention.

Next, embodiments of the present invention will be discussed hereinafter with reference to the drawings. Some embodiments may be applied to a starting device for a motorcycle, a three-wheeled vehicle, a four-wheeled vehicle, etc., and some embodiments may particularly relate to a starting device for a small-sized vehicle in which there is a limitation on available space around an ignition switch.

According to some embodiments of the present invention, even if chattering occurs in the ignition switch, the supply of electric power is ensured by a relay in the sub power source line extending from the power source to the ECU, so that an interruption of the supply of the electric power to the ECU can be prevented. Moreover, large and expensive parts, such as diodes, are not required and, with a simple structure, it is possible to prevent a failure upon starting the vehicle that is brought about by the interruption of the supply of the electric power to the ECU due to chattering.

According to some embodiments of the present invention, when the voltage for starting the vehicle is in short supply, for example, when the remaining capacity of the battery is reduced, the relay can be brought into a state where it is not electrically continued, and the battery can be prevented from being drained or running out.

According to some embodiments of the present invention, by the off-operation of the ignition switch that causes the movable contact to be turned off, the main power source line (for example, the main power source line 40 of FIG. 3) can be turned off. The electric continuity of the relay is interrupted after the passage of a predetermined time and the line of the relay (for example, the sub power source line 41 of FIG. 3) can be turned off, such that both of the lines are turned off.

According to some embodiments of the present invention, the predetermined time is set to be longer than the time for disconnecting the power source line due to the chattering. This distinguishes between the disconnection of the power source line due to the chattering and the disconnection of the power source line due to the off-operation of the movable contact.

According to some embodiments of the present invention, when the relay is not interrupted even if the predetermined time elapses, the system determines that the relay is not functioning properly (for example, when the relay is locked in a closed state), and the engine can be stopped by an ignition cut-off and a fuel cut-off. Therefore, even if the relay fails, it is possible to stop the engine according to the off-operation of the ignition switch.

According to some embodiments of the present invention, the system determines whether or not the relay is locked in the closed state and the engine can be stopped accordingly. According to some embodiments of the present invention, the system determines whether or not the relay is locked in an opened state and the failure of the relay can be conveyed to a user. According to some embodiments of the present invention, the engine drive system load is connected through the relay to the power source such that even if chattering occurs in the ignition switch, the engine drive system load can be operated without being subjected to the effect of the chattering.

FIGS. 1(*a*)-(*c*) and 2(*a*)-(*c*) show an ignition switch 1 according to an embodiment of the present invention. As shown in FIG. 1(*a*), the ignition switch 1 includes a ring portion 2 with a rotating portion 4 having an insertion hole 3 for an unshown ignition key. The rotating portion 4 is configured to be rotated about a shaft-supported portion J thereof as shown in FIGS. 1(*b*) and 1(*c*).

At an OFF-position, an ON-(main) position, and a ST (starter) position that are located at a position of the ring portion 2 that extends from a 12 o'clock direction to a 4 o'clock direction, stages are provided. By rotating the rotating portion 4 when the ignition key is inserted into the insertion hole 3, a movable contact 5, which will be discussed hereinafter with respect to FIG. 1(*c*), is rotated and configured to be brought into electric continuity with a necessary contact of a stationary contact 6 (see FIG. 1(*b*). Here, an accessory position is included in the ON-position. Incidentally, in FIGS. 1(*a*)-(*c*), an upward direction is referred to as the 12 o'clock direction, a downward direction is referred to as a 6 o'clock direction, a right direction is referred to as a 3 o'clock direction, and a left direction is referred to as a 9 o'clock direction.

FIG. 1(*b*) shows the stationary contact 6. The stationary contact 6 is provided with a pair of inner battery-contacts 7 and 7-1 having arch-shapes (connected to a battery 20 shown in FIG. 3) that are arranged at the right and left sides of the stationary contact 6 in the 3 o'clock and 9 o'clock directions, respectively. The stationary contact 6 also includes an arched main-contact 8 (connected to a power source input terminal VB of an ECU 21 per FIG. 3) and an arched accessory-contact 8-1 (connected to an accessory load 23 per FIG. 3) that are respectively arranged outside the battery contacts 7 and 7-1 in the 3 o'clock and 9 o'clock directions, respectively. Moreover, a dot-shaped starter-contact 9 (connected to a coil 30 of a starter magnet switch 26 per FIG. 3) is provided that is spaced apart from the main contact 8 in the 4 o'clock direction on an extension line of a circumferential direction (in other words, located on the same circle) to the main contact 8 located in the 3 o'clock direction.

FIG. 1(*c*) illustrates the movable contact 5. The movable contact 5 is a member that is rotated together with the rotating portion 4 around the shaft-supported portion J with respect to the stationary contact 6. The movable contact 5 is provided with three dot-shaped contacts 10, 11*a*, and 11*b* at each of the left and right sides of the movable contact 5, and includes an electric continuity portion 12 for providing electric continuity of the three contacts 10, 11*a*, and 11*b* on the left side and an electric continuity portion 12 for providing electric continuity of the three contacts 10 and 11 on the right side.

The three contacts 10, 11*a*, and 11*b* on the left and right sides include movable battery-contacts 10 on the inner side that correspond to the battery contacts 7 and 7-1 of the stationary contact 6. Two movable main-contacts 11*a* and 11*b* that correspond to the main contact 8 and the accessory contact 8-1 of the stationary contact 6 are provided on the outer side of the electric continuity portions 12. The two movable main-contacts 11*a* and 11*b* on the outer side are set in a space between the starter contact 9 of the stationary contact 6 and an end portion of the main contact 8 adjacent the starter contact 9 that is located on the clockwise side.

Figure 2:
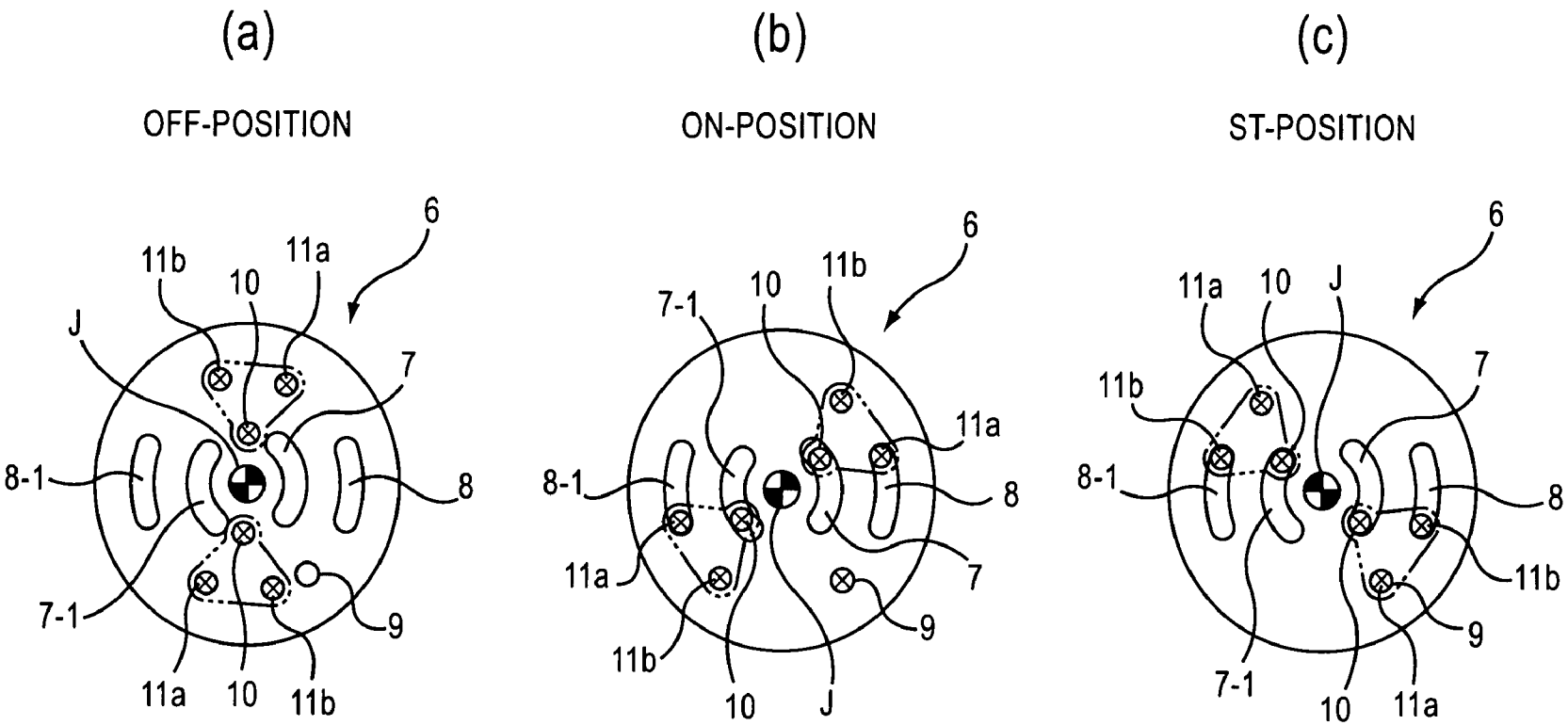
FIG. 2(*a*) illustrates an internal view of an ignition switch exposing a stationary contact and a movable contact in the off position according to an embodiment of the present invention.

Therefore, when a connection position relationship between the stationary contact 6 and the movable contact 5 (shown as a dotted line) is shown in FIGS. 2(*a*)-(*c*), the OFF-position of the ignition switch 1 is a position in which any of the movable battery-contacts 10 on the left and right sides and any of the stationary main-contacts 11*a* and 11*b* on the left and right sides are not contacted with the stationary contact 6, as shown in FIG. 2(*a*).

Figure 3:
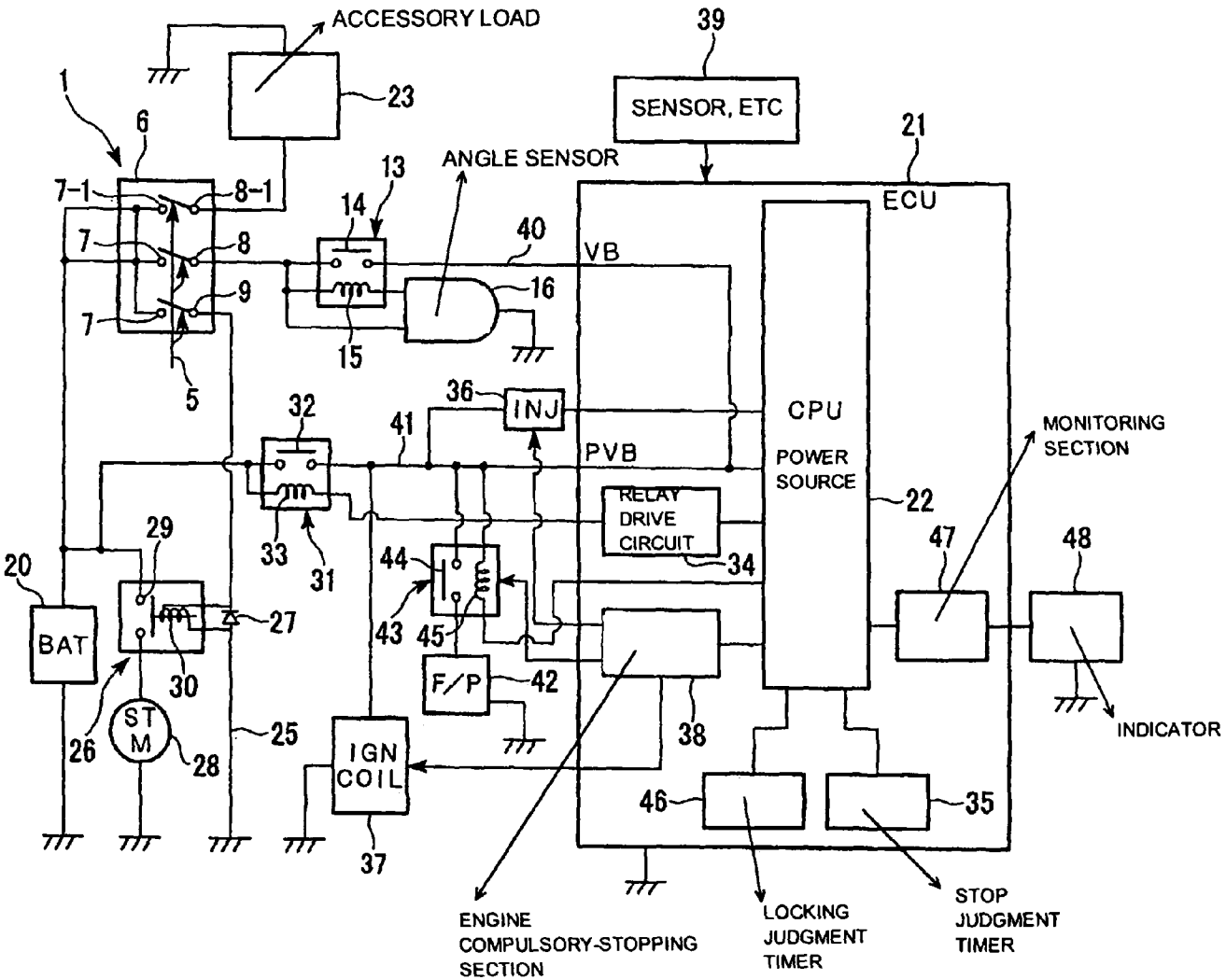
FIG. 3 illustrates a circuit diagram of an engine starting device according to an embodiment of the present invention.

Moreover, as shown in FIG. 2(*b*), the ON (main) position is a position in which the movable battery-contacts 10 of the movable contact 5 are connected to the battery contacts 7 and 7-1 of the stationary contact 6 and the movable main-contact 11*a* on the clockwise side of the movable contact 5 is connected to the main contact 8 and accessory contact 8-1 of the stationary contact 6 so that, as shown in FIG. 3, the battery (BAT) 20 and a main power source line 40 (central processing unit (CPU) 22) are electrically continued through the main contact 8 and connected to the power source input terminal VB of the ECU 21. The battery 20 and the accessory load 23 are then brought into an electric continuity state through the accessory contact 8-1.

Further, as shown in FIG. 2(*c*), the ST (starter) position is a position in which electric continuity across the battery 20 and a starter motor 28 (see FIG. 3) is established since the movable battery-contacts 10 of the movable contact 5 are connected to the battery contacts 7 and 7-1 of the stationary contact 6, the movable main-contact 11*b* on the counterclockwise side of the movable contact 5 is connected to the main contact 8 and accessory contact 8-1 of the stationary contact 6. More specifically, an energized state at the ON-position (the main power source line 40 and the accessory load 23 are brought into electric continuity with the battery 20) is maintained and the movable main-contact 11*b* on the clockwise side of the movable contact 5 is connected to the starter contact 9 of the stationary contact 6.

FIG. 3 shows a circuit diagram of an engine starting device according to an embodiment of the present invention. The battery 20 is connected to the ignition switch 1 and the ignition switch 1 is connected to the power source input terminal VB of the ECU 21 serving as a control device and connected through the main power source line 40 to a power source input terminal of a CPU 22 (indicated as a power source in FIG. 3) serving as a processing device provided in the ECU 21. Here, electrical power is supplied to the power source input terminal of the CPU 22 so that the ECU 21 is brought into electric continuity with the battery 20 and brought into a start state. Additionally, an unshown generator and an unshown regulator are connected to the battery 20 and perform electrical charging of the battery 20.

In the ignition switch 1, the battery contact 7-1 and accessory contact 8-1 of the stationary contact 6, the battery contact 7 and the main contact 8, and the battery contact 7 and the starter contact 9 can be configured to be connected by the movable battery-contacts 10 and movable main-contacts 11*a* and 11*b* of the movable contact 5.

In this example, the accessory contact 8-1 of the stationary contact 6 is connected to the accessory load 23. The main contact 8 of the stationary contact 6 is connected to the power source input terminal of the CPU 22 through a relay contact 14 of a relay 13 on the main power source line 40 and through the power source input terminal VB of the ECU 21. One end of a relay coil 15 of the relay 13 is connected to the main power source line 40. The other end of the relay coil 15 is connected, together with another line branched from the main power source line 40, to an angle sensor 16. The starter contact 9 of the stationary contact 6 is connected, as a contact for the starter, to a ground connection line 25 on which a diode 27 of the starter magnet switch 26 is provided.

Also in this example, a stationary contact 29 of the starter magnet switch 26 is connected between the battery 20 and the starter motor 28. The coil 30 of the starter magnet switch 26 is connected at one end thereof to the starter contact 9 and connected at the other end thereof to the ground connection line 25. The diode 27 is connected in parallel to the coil 30. Accordingly, the diode 27 is connected in such a direction that the flow of electric current toward the earth is prevented. In this way, the starter contact 9 is connected to the battery 20 such that the relay 30 is turned on and the stationary contact 29 is connected to the starter motor 28.

A relay 31 is provided at the battery 20 in parallel to the main power source line 40 on which the ignition switch 1 is provided. The relay 31 is branch-connected between the battery 20 and the starter magnet switch 26. The relay 31 includes a relay contact 32 and a relay coil 33, the relay contact 32 being connected via a sub power source line 41 to the power source input terminal of the CPU 22 through a sub power source input terminal PVB in the ECU 21. The relay coil 33 is connected to the CPU 22 via a relay drive circuit 34 in the ECU 21. The main power source line 40 and the sub power source line 41 are merged onto a single line and thus are commonly-connected to the power source input terminal of the CPU 22 in the ECU 21.

The relay drive circuit 34 allows electric current to flow to the relay coil 33 when a voltage (for example, 8 volts (V)) greater than or equal to a predetermined level is applied to the CPU 22 and causes the relay contact 32 to be connected. Moreover, the relay drive circuit 34 can stop energization of the relay coil 33 when a first predetermined time (for example, 300 ms) elapses since the turning-off of the ignition switch 1 through a stop judgment timer 35 that is connected to the CPU 22 and releases the relay contact 32. This first predetermined time is set to a level that is sufficiently greater than the chattering time to make it possible to distinguish between the chattering and the off-operation of the ignition switch 1.

Figure 4:
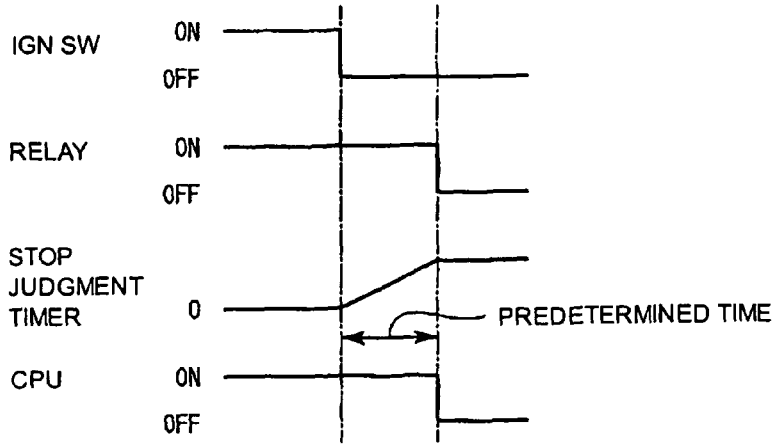
FIG. 4 illustrates a timing diagram for an engine starting device at the time that a power source is off according to an embodiment of the present invention.

FIG. 4 illustrates a timing diagram for an engine starting device at the time that a power source is off according to an embodiment of the present invention. With respect to the circuitry shown in FIG. 3, when the ignition switch (IGN SW) 1 is brought into an on-state (ON) from an off-state (OFF), the stop judgment timer 35 begins counting from zero. When the stop judgment timer 35 reaches a predetermined value, the relay contact 32 of the relay 31 is brought to an off-state (OFF) from an on-state (ON). Thus, the CPU 22 is brought into an off-state (OFF) from an on-state (ON).

Moreover, an injector (INJ) 36 for injecting fuel, a fuel pump (F/P) 42 and an ignition coil (IGNCOIL) 37 that make up an engine drive system load are connected to the sub power source line 41. An unshown plug is connected to the ignition coil 37. Here, a relay 43 is provided between the fuel pump 42 and the sub power source line 41, a relay contact 44 of the relay 43 is connected to the fuel pump 42, and the relay contact 32 is configured to be connected by a relay coil 45 that is connected between the CPU 22 and the sub power source line 41.

An engine compulsory-stopping section 38 is provided in the ECU 21. The engine compulsory-stopping section 38 acts on the injector 36, the fuel pump 42, and the ignition coil 37, and stops the fuel injection and ignition even when the relay contact 32 is locked in a closed state, thus stopping an engine by a fuel cut and an ignition cut. Here, in order to judge whether or not the relay contact 32 is locked in the closed state when an electric continuity state of the relay contact 32 is not released, even if the first predetermined time elapses after the stop of the engine, a locking judgment timer 46 is connected to the CPU 22. A second predetermined time is further measured by the locking judgment timer 46 after the measuring of the first predetermined time by the stop judgment timer 35 and the locking of the relay contact 32 in the closed state is determined. In this case, the fuel injection and ignition are compulsorily stopped by the engine compulsory-stopping section 38 and the engine is stopped by the fuel cut and the ignition cut. Further, a monitoring section 47 is provided at the CPU 22. An indicator 48 is connected to the monitoring section 47.

Figure 5:
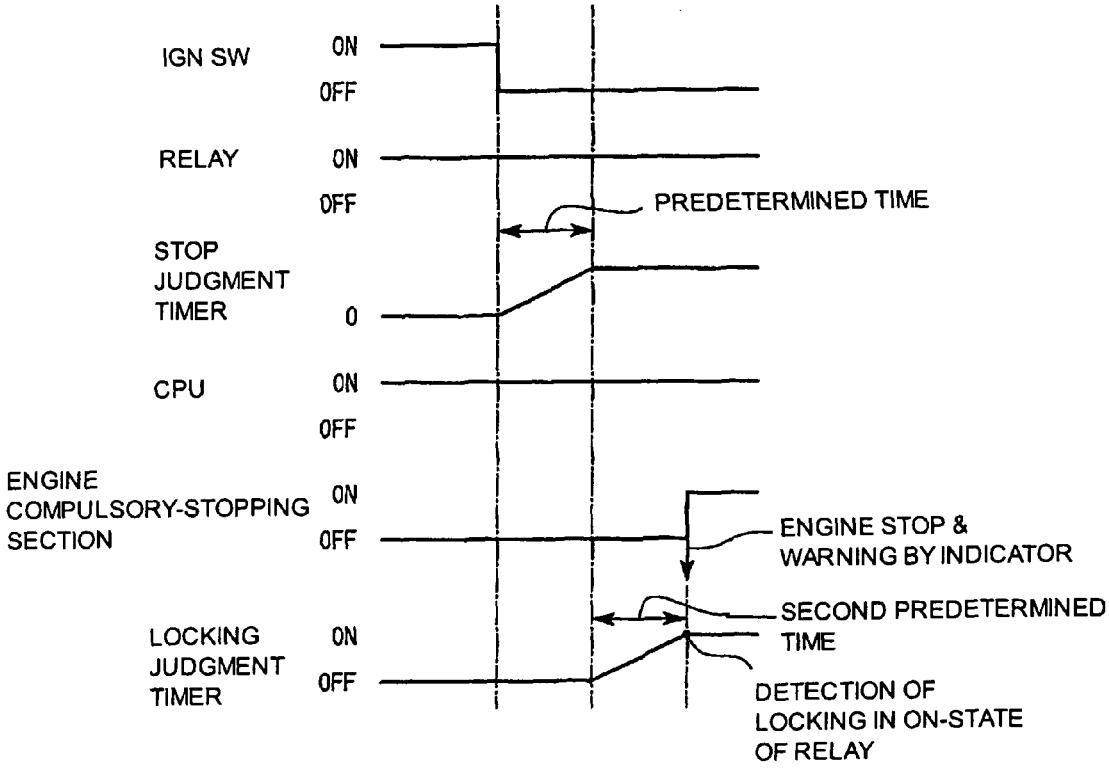
FIG. 5 illustrates a timing diagram for an engine starting device at the time that a relay is locked in a closed state according to an embodiment of the present invention.

FIG. 5 illustrates a timing diagram for an engine starting device at the time that a relay is locked in a closed state according to an embodiment of the present invention. The electric continuity state of the relay contact 32 is not released even if the ignition switch 1 is turned off, the first predetermined time and the second predetermined time elapses, and the engine is compulsorily stopped.

If the ignition switch 1 is turned off from the on-state, the stop judgment timer 35 starts the time measurement from zero, the electric continuity state of the relay 31 is not released even if the first predetermined time elapses, the locking judgment timer 46 starts the time measurement, and the relay contact 32 of the relay 31 remains in the on-state (ON) even if the second predetermined time elapses. The CPU 22 remains in the on-state (ON) so that it is determined that the relay 31 is locked in the closed state, the fuel cut and the ignition cut are performed by the engine compulsory-stopping section 38, and the engine is compulsorily stopped. At this time, though the CPU 22 remains in the on-state (ON), a warning is provided by the indicator 48 through the monitoring section 47, thus making it possible to inform a user of a failure of the relay 31. Additionally, various sensors 39 or the like are connected to the ECU 21.

Figure 6:
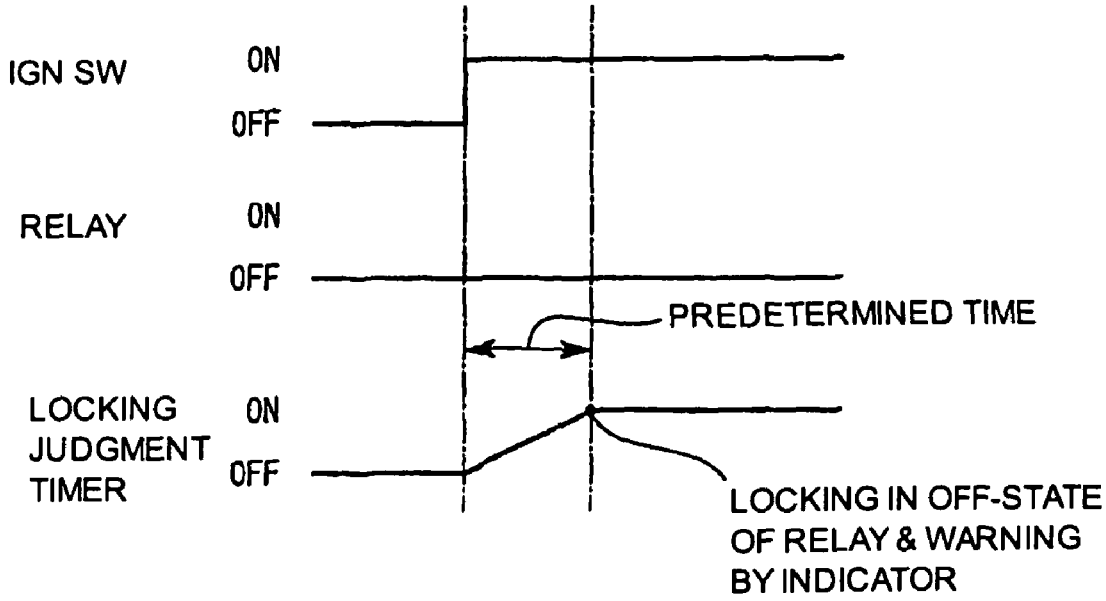
FIG. 6 illustrates a timing diagram for an engine starting device at the time that a relay is locked in an open state according to an embodiment of the present invention.

FIG. 6 illustrates a timing diagram for an engine starting device at the time that a relay is locked in an open state, according to an embodiment of the present invention. When the ignition switch 1 is turned on and the relay contact 32 is not brought into the electric continuity even if the first predetermined time elapses, a warning is provided.

If the ignition switch 1 is turned on from the off-state, the locking judgment timer 46 starts the time-measurement and the relay contact 32 of the relay 31 is not turned on (ON) (even if the first predetermined time elapses), the system determines that the relay 31 is locked in an opened state and the CPU 22 is turned on (ON) by the main power source line 40. The warning is provided by the indicator 48 through the monitoring section 47, thus making it possible to inform the user of the failure of the relay 31.

Here, the timing of starting of the time-measurement by the locking judgment timer 46 is different when it is determined that the relay 31 is locked in the closed state and when it is determined that the relay 31 is locked in the opened state. In other words, the time-measurement when it is determined that the relay 31 is locked in the closed state is started on completion of the time-measurement by the stop judgment timer 35 after the off-operation of the ignition switch 1. Also, the time-measurement in the case of the judgment when it is determined that the relay 31 is locked in the opened state is started immediately after the on-operation of the ignition switch 1. Therefore, the timing of the measurement is varied when it is determined that the relay 31 is locked according to the off-operation and on-operation of the ignition switch 1.

Referring to FIGS. 1 and 3, when the ignition key is inserted into the insertion hole 3 of the ignition switch 1 and the rotating portion 4 is turned in the right direction to the ON-position, the accessory contact 8-1 and the main contact 8 are brought into the on-states and, when the rotating portion 4 is further turned to the ST position from the ON-position, the contacts of the ignition switch 1 are all brought into the on-states. Here, when the ignition switch 1 is located at the ON-position and a voltage greater than or equal to 8V is applied to the CPU 22, the relay coil 33 of the relay 31 is excited through the relay drive circuit 34 and the relay contact 32 is brought into the on-state. Here, as shown in FIG. 6, when it is determined through the time-measurement of the first predetermined time that is performed by the locking judgment timer 46 that, regardless of the on-operation of the ignition switch 1, the relay contact 32 remains in the off-state and is locked, a warning is provided by the indicator 48, thus making it possible to inform the user of the failure of the relay 31.

Also, when the ignition switch 1 starts the engine at the ST position, even if chattering occurs in the ignition switch 1 and the main power source line 40 to which the CPU 22 is connected through the ignition switch 1 is disconnected from the battery 20, the sub power source line 41 between the battery 20 and the CPU 22 can be ensured by the relay 31 so that the an interruption of the supply of electric power from the battery 20 to the ECU 21 (CPU 22) can be prevented. Therefore, the CPU 22 is not brought into the off-state and the startability of the engine is not impaired.

Further, provision of large-sized and expensive parts, such as diodes, around the ignition switch 1 is not required so that with less structure, it is possible to prevent the impairment to starting resulting from the chattering.

Only when the voltage greater than or equal to 8V is applied to the CPU 22, the relay 32 causes the relay drive circuit 34 to operate and the relay is brought into the electric continuity state, so when the remaining capacity of the battery 20 is reduced and the voltage drops and is less than or equal to 8V, the electric continuity of the relay 31 can be prevented and the battery can be prevented from running-out.

As shown in FIG. 4, after the movable contact 5 is turned to the OFF-position, the first predetermined time elapses through the stop judgment timer 35, the operation of the relay 31 is stopped and the relay 31 is released from the electric continuity state so that the off-operation of the ignition switch 1 that brings the movable contact 5 into the off-state can bring the main power source line 40 into the off-state and interrupt the electric continuity of the relay 31 to bring the sub power source line 41 of the relay 31 into the off-state, thus making it possible to bring the both lines into the off-states. Moreover, the first predetermined time is set to a duration longer than a duration of the chattering occurring in the ignition switch 1 that is repeatedly turned on and off at a time interval of 170 ms or so by the stop judgment timer 35 as required for the stop judgment so that it is possible to distinguish the chattering and the off-operation of the ignition switch 1.

Further, as shown in FIG. 5, when the electric continuity state of the relay 31 is not released even if the first predetermined time elapses through the stop judgment timer 35 after the movable contact 5 is turned to the OFF-position, the time-measurement is further performed by the locking judgment timer 46 and, when the electric continuity state of the relay 31 is not released even if the second predetermined time elapses, it is determined that the relay 31 has failed (locking of the relay in the closed state), and it is possible to stop the engine by the ignition cut and the fuel cut so that even if the relay 31 is locked in the closed state, the engine can be securely stopped according to the off-operation of the ignition switch 1.

The engine drive system load that includes the ignition coil 37, the injector 36, the fuel pump 42, etc., is connected to the sub power source line 41 on which the relay 31 is provided so that even if chattering occurs in the ignition switch 1, the effect of the chattering is not exerted on the sub power source line 41, which is different from the main power source line 40, on which the ignition switch 1 is provided, and the engine drive system load such as the ignition coil 37, the injector 36, the fuel pump 42, etc., can be operated without being subjected to the effect of the chattering.

The present invention is not limited to the above-mentioned embodiments. For example, the threshold value of 8 volt (V) for driving the relay drive circuit 34 is employed as an example and the threshold value is not limited to this. Moreover, while the stop judgment timer 35 and the locking judgment timer 46 are provided has been discussed above, the time-measurement may be performed in a varied manner by a single timer.

One having ordinary skill in the art will readily understand that the invention as discussed above may be practiced in a different order, and/or with hardware elements in configurations that are different than those that are disclosed. Therefore, although the invention has been described based upon these preferred embodiments, it would be apparent to, and readily appreciated by, those of ordinary skill in the art that certain modifications, variations, and alternative constructions would be apparent, while remaining within the spirit and scope of the invention. In order to determine the metes and bounds of the invention, therefore, reference should be made to the appended claims.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

DESCRIPTION OF REFERENCE NUMERALS

1 . . . Ignition switch
5 . . . Movable contact
6 . . . Stationary contact
8 . . . Main contact
9 . . . Starter contact
20 . . . Battery (Power source)
21 . . . Engine Control Unit (ECU)
26 . . . Starter magnet switch (Starter)
31 . . . Relay
34 . . . Relay drive circuit (Relay drive means)
36 . . . Injector (Engine drive system load)
37 . . . Ignition coil (Engine drive system load)
40 . . . Main power source line
41 . . . Sub power source line
42 . . . Fuel pump (Engine drive system load)
VB . . . Power source input terminal (Power source input section)
PVB . . . Sub power source input terminal (Sub power source input section)

We claim:

1. An engine starting device, comprising:

an ignition switch configured to cause turning-on and off of a main power source line connecting a power source for a vehicle and an engine control unit (ECU), the ignition switch comprising a stationary contact and a movable contact that is rotatable relative to the stationary contact, wherein the stationary contact comprises a main contact configured to be connected to a power source input section of the ECU and a starter contact configured to be connected to a starter, the movable contact is configured switch its connection/disconnection with the respective contacts of the stationary contact by the rotation of the movable contact to an off-position, an on-position and a starter position relative to the stationary contact, and both the main contact and the starter contact are configured to be connected to the power source of the vehicle when the movable contact is rotated to the starter contact; and a relay provided on a sub power source line that is connected in parallel to the main power source line, the relay connecting the power source of the vehicle and a sub power source input section of the ECU, the relay being excited by the start of the ECU and providing electric continuity between the power source and the ECU.

2. The engine starting device according to claim 1, wherein the relay operates a relay drive when a voltage greater than or equal to a first predetermined voltage is applied to the power source input section of the ECU and the relay is brought into an electric continuity state.

3. The engine starting device according to claim 1, wherein operation of the relay is stopped after a passage of a first predetermined time following the movable contact being rotated to the off-position, the relay being released from an electric continuity state.

4. The engine starting device according to claim 3, wherein the first predetermined time is set to a larger duration than a time required to interrupt the power source line due to chattering.

5. The engine starting device according to claim 1, wherein an engine is stopped by an ignition cut and a fuel cut when the electric continuity state of the relay is not released after a first predetermined time elapses following the movable contact being rotated to the off-position.

6. The engine starting device according to claim 5, wherein when the electric continuity state of the relay is not released after the first predetermined time elapses, a second predetermined time is measured and, when the electric continuity state of the relay is not released after the second predetermined time elapses, the stopping of the engine is performed by the ignition cut and the fuel cut.

7. The engine starting device according to claim 1, wherein when the relay is not electrically continued after a predetermined time elapses following the movable contact being rotated to the on-position, a warning is provided by an indicator.

8. The engine starting device of claim 1, wherein an engine drive system load that includes a fuel injection device and an ignition coil is connected through the relay to the power source.

9. A method, comprising:

rotating a movable contact relative to a stationary contact, switching a connection/disconnection of the movable contact with respective contacts of the stationary contact by the rotation of the movable contact to an off-position, an on-position and a starter position relative to the stationary contact; and exciting a relay by a start of an engine control unit (ECU), where the relay is provided on a sub power source line that is connected in parallel to a main power source line, the relay connects a power source of a vehicle and a sub power source input section of the ECU and the relay provides electric continuity between the power source and the ECU.

10. The method according to claim 9, further comprising:

operating a relay drive, via the relay, when a voltage greater than or equal to a first predetermined voltage is applied to the power source input section of the ECU and the relay is brought into an electric continuity state.

11. The method according to claim 9, further comprising:

stopping operation of the relay after a passage of a first predetermined time following the movable contact being rotated to the off-position, the relay being released from an electric continuity state.

12. The method according to claim 11, wherein the first predetermined time is set to a larger duration than a time required to interrupt the power source line due to chattering.

13. The method according to claim 9, further comprising:

stopping an engine by an ignition cut and a fuel cut when the electric continuity state of the relay is not released after a first predetermined time elapses following the movable contact being rotated to the off-position.

14. The method according to claim 13, wherein when the electric continuity state of the relay is not released after the first predetermined time elapses, the method further comprises:

measuring a second predetermined time; and when the electric continuity state of the relay is not released after the second predetermined time elapses, the stopping of the engine if performed by the ignition cut and the fuel cut.

15. The method according to claim 9, further comprising:

providing a warning by an indicator when the relay is not electrically continued after a predetermined time elapses following the movable contact being rotated to the on-position.

16. The method of claim 9, wherein an engine drive system load that includes a fuel injection device and an ignition coil is connected through the relay to the power source.

17. An ignition switch, comprising:

a stationary contact and a movable contact that is rotatable relative to the stationary contact, wherein the stationary contact comprises a main contact configured to be connected to a power source input section of an engine control unit (ECU) and a starter contact configured to be connected to a starter, the movable contact is configured switch its connection/disconnection with the respective contacts of the stationary contact by the rotation of the movable contact to an off-position, an on-position and a starter position relative to the stationary contact, and both the main contact and the starter contact are configured to be connected to the power source of a vehicle when the movable contact is rotated to the starter contact, wherein operation of a relay is stopped after a passage of a first predetermined time following the movable contact being rotated to the off-position, the relay being released from an electric continuity state.

18. The ignition switch according to claim 17, wherein the relay operates a relay drive when a voltage greater than or equal to a first predetermined voltage is applied to the power source input section of the ECU and the relay is brought into an electric continuity state.

19. The ignition switch according to claim 17, wherein operation of the relay is stopped after a passage of a first predetermined time following the movable contact being rotated to the off-position, the relay being released from an electric continuity state.

20. The ignition switch according to claim 17, wherein when the electric continuity state of the relay is not released after the first predetermined time elapses, a second predetermined time is measured and, when the electric continuity state of the relay is not released after the second predetermined time elapses, the engine is stopped by the ignition cut and the fuel cut.

21. An engine starting device, comprising:

ignition switch means for causing turning-on and off of a main power source line connecting a power source for a vehicle and an engine control unit (ECU), the ignition switch means comprising stationary contact means and movable contact means that is rotatable relative to the stationary contact means, wherein the stationary contact means comprises main contact means for connecting to a power source input section of the ECU and starter contact means for connecting to a starter, the movable contact means is configured switch its connection/disconnection with the respective contacts of the stationary contact means by the rotation of the movable contact means to an off-position, an on-position and a starter position relative to the stationary contact means, and both the main contact means and the starter contact means are configured to be connected to the power source of the vehicle when the movable contact means is rotated to the starter contact means; and relay means provided on a sub power source line that is connected in parallel to the main power source line, the relay means connecting the power source of the vehicle and a sub power source input section of the ECU, the relay means being excited by the start of the ECU and providing electric continuity between the power source and the ECU.

* * * * *